US009688920B2

(12) United States Patent
Gordon et al.

(10) Patent No.: US 9,688,920 B2
(45) Date of Patent: Jun. 27, 2017

(54) PROCESS TO SEPARATE ALKALI METAL SALTS FROM ALKALI METAL REACTED HYDROCARBONS

(71) Applicant: FIELD UPGRADING LIMITED, Calgary (CA)

(72) Inventors: John Howard Gordon, Salt Lake City, UT (US); Javier Alvare, Cottonwood Heights, UT (US); Dennis Larsen, Salt Lake City, UT (US); Jeff Killpack, Sandy, UT (US)

(73) Assignee: FIELD UPGRADING LIMITED, Calgary (CA)

( * ) Notice: Subject to any disclaimer, the term of this patent is extended or adjusted under 35 U.S.C. 154(b) by 0 days.

(21) Appl. No.: 14/253,286

(22) Filed: Apr. 15, 2014

(65) Prior Publication Data

US 2014/0224709 A1 Aug. 14, 2014

Related U.S. Application Data

(63) Continuation-in-part of application No. 13/753,918, filed on Jan. 30, 2013, now Pat. No. 8,747,660, and a (Continued)

(51) Int. Cl.
*C10G 29/04* (2006.01)
*C10G 1/00* (2006.01)

(Continued)

(52) U.S. Cl.
CPC ..... *C10G 29/04* (2013.01); *C25B 1/00* (2013.01); *C25C 1/02* (2013.01);

(Continued)

(58) Field of Classification Search
CPC .... C10G 2300/1025; C10G 2300/1081; C10G 2300/1088; C10G 2300/202;

(Continued)

(56) References Cited

U.S. PATENT DOCUMENTS 1,501,756 A 7/1924 Downs
2,055,210 A * 9/1936 Vose ..... C10G 29/02 208/13

(Continued)

FOREIGN PATENT DOCUMENTS

CA 2531262 A1 6/2007
DE 2558505 11/1976

(Continued)

OTHER PUBLICATIONS

Non-Final Office Action on U.S. Appl. No. 13/679,696, mailed Jul. 14, 2015.

(Continued)

*Primary Examiner* — Renee Robinson
*Assistant Examiner* — Derek Mueller
(74) *Attorney, Agent, or Firm* — Foley & Lardner LLP

(57) ABSTRACT

A process to facilitate gravimetric separation of alkali metal salts, such as alkali metal sulfides and polysulfides, from alkali metal reacted hydrocarbons. The disclosed process is part of a method of upgrading a hydrocarbon feedstock by removing heteroatoms and/or one or more heavy metals from the hydrocarbon feedstock composition. This method reacts the oil feedstock with an alkali metal and an upgradant hydrocarbon. The alkali metal reacts with a portion of the heteroatoms and/or one or more heavy metals to form an inorganic phase containing alkali metal salts and reduced heavy metals, and an upgraded hydrocarbon feedstock. The inorganic phase may be gravimetrically separated from the upgraded hydrocarbon feedstock after mixing at a temperature between about 350° C. to 400° C. for a time period between about 15 minutes and 2 hours.

19 Claims, 2 Drawing Sheets

Related U.S. Application Data continuation-in-part of application No. 12/916,984, filed on Nov. 1, 2010, now Pat. No. 8,828,220.

(60) Provisional application No. 61/812,057, filed on Apr. 15, 2013, provisional application No. 61/594,846, filed on Feb. 3, 2012, provisional application No. 61/257,369, filed on Nov. 2, 2009.

(51) Int. Cl.
*C10G 1/02* (2006.01)
*C25C 1/02* (2006.01)
*C25B 1/00* (2006.01)

(52) U.S. Cl.
CPC ..... *C10G 2300/1025* (2013.01); *C10G 2300/1081* (2013.01); *C10G 2300/1088* (2013.01); *C10G 2300/202* (2013.01); *C10G 2300/205* (2013.01)

(58) Field of Classification Search
CPC .. C10G 2300/205; C10G 29/04; C10G 19/00; C10G 19/02; C10G 19/067; C10G 19/073; C10G 19/08
See application file for complete search history.

(56) References Cited

U.S. PATENT DOCUMENTS

| | | | | |
|---|---|---|---|---|
| 2,249,340 | A | | 7/1941 | Wilson |
| 2,772,211 | A | | 11/1956 | Hawkes et al. |
| 2,836,633 | A | | 5/1958 | Esmay et al. |
| 3,164,545 | A | * | 1/1965 | Judson ..... C10G 19/067 208/230 |
| 3,497,569 | A | | 2/1970 | Stiles |
| 3,565,792 | A | | 2/1971 | Haslett, |
| 3,785,965 | A | | 1/1974 | Welty |
| 3,787,315 | A | * | 1/1974 | Bearden, Jr. ..... C01B 17/34 205/408 |
| 3,788,978 | A | | 1/1974 | Bearden, Jr. et al. |
| 3,791,966 | A | | 2/1974 | Bearden |
| 3,960,708 | A | | 6/1976 | McCollum et al. |
| 4,076,613 | A | | 2/1978 | Bearden, Jr. |
| 4,428,828 | A | | 1/1984 | Bose |
| 4,454,017 | A | | 6/1984 | Swanson |
| 4,500,414 | A | | 2/1985 | Audeh |
| 4,501,652 | A | | 2/1985 | Le et al. |
| 4,606,812 | A | | 8/1986 | Swanson |
| 5,328,577 | A | | 7/1994 | Murphy |
| 5,695,632 | A | | 12/1997 | Brons et al. |
| 5,750,814 | A | | 5/1998 | Grootjans et al. |
| 5,935,419 | A | | 8/1999 | Khan et al. |
| 5,935,421 | A | | 8/1999 | Brons et al. |
| 6,132,590 | A | | 10/2000 | Moran et al. |
| 6,210,564 | B1 | | 4/2001 | Brons et al. |
| 6,280,128 | B1 | | 8/2001 | Shrader |
| 6,368,486 | B1 | | 4/2002 | Thompson et al. |
| 6,413,898 | B1 | | 7/2002 | Faber et al. |
| 6,635,795 | B2 | | 10/2003 | Gislason et al. |
| 6,697,987 | B2 | | 2/2004 | Lee et al. |
| 6,706,902 | B2 | | 3/2004 | Sturmann et al. |
| 6,734,133 | B1 | | 5/2004 | Weisbeck et al. |
| 6,787,019 | B2 | | 9/2004 | Jacobson et al. |
| 7,504,023 | B2 | | 3/2009 | Pravia et al. |
| 7,897,028 | B2 | | 3/2011 | Gordon et al. |
| 8,088,270 | B2 | | 1/2012 | Gordon et al. |
| 8,828,220 | B2 | | 9/2014 | Gordon |
| 2002/0011430 | A1 | | 1/2002 | Greaney |
| 2002/0125175 | A1 | | 9/2002 | Collins et al. |
| 2005/0145545 | A1 | | 7/2005 | Schucker |
| 2005/0161340 | A1 | | 7/2005 | Gordon et al. |
| 2006/0054538 | A1 | | 3/2006 | Hsu et al. |
| 2006/0138029 | A1 | | 6/2006 | Malek et al. |
| 2007/0087934 | A1 | | 4/2007 | Martens et al. |
| 2008/0031792 | A1 | | 2/2008 | Ciccarelli et al. |
| 2008/0251422 | A1 | | 10/2008 | Baez et al. |
| 2009/0134040 | A1 | | 5/2009 | Gordon et al. |
| 2009/0134059 | A1 | | 5/2009 | Myers et al. |
| 2009/0259082 | A1 | | 10/2009 | Deluga et al. |
| 2010/0089762 | A1 | | 4/2010 | Gordon |
| 2010/0155298 | A1 | | 6/2010 | Raterman et al. |
| 2010/0187124 | A1 | | 7/2010 | Koveal |
| 2010/0276335 | A1 | | 11/2010 | Shucker |
| 2010/0297531 | A1 | | 11/2010 | Liu et al. |
| 2010/0297537 | A1 | | 11/2010 | Coors et al. |
| 2010/0304953 | A1 | | 12/2010 | Liu et al. |
| 2011/0054232 | A1 | | 3/2011 | Sangar et al. |
| 2011/0100874 | A1 | | 5/2011 | Gordon |
| 2011/0119994 | A1 | | 5/2011 | Hogendoorn et al. |
| 2011/0155647 | A1 | | 6/2011 | Serban et al. |
| 2012/0304530 | A1 | | 12/2012 | Chitta et al. |
| 2013/0043160 | A1 | | 2/2013 | Gordon |
| 2013/0140217 | A1 | | 6/2013 | Gordon et al. |
| 2013/0153469 | A1 | | 6/2013 | Gordon |

FOREIGN PATENT DOCUMENTS

| | | | |
|---|---|---|---|
| KR | 2006-0032194 | | 4/2006 |
| WO | WO-97/08270 | | 3/1997 |
| WO | WO-02099013 | | 12/2002 |
| WO | WO-2005/066302 | | 7/2005 |
| WO | WO2010016899 | | 1/2010 |
| WO | WO-2010124030 | | 10/2010 |
| WO | WO-2011012900 | | 2/2011 |
| WO | WO-2011/053919 | A2 | 5/2011 |
| WO | WO2011053919 | | 9/2011 |
| WO | WO2012147097 | | 11/2012 |
| WO | WO2013019596 | | 2/2013 |

OTHER PUBLICATIONS

Reggel, et al., "Desulphurization of Gasoline by Metallic Sodium", *Fuel,* vol. 55, (Jul. 1976),170-172.

Byun, Sang H., "International Search Report", International Search Report for PCT US 2010/054984 (Corresponding to U.S. Appl. No. 12/916,984), (Jul. 28, 2011),1-3.

Byun, Sang H., "Written Opinion of the International Searching Authority", Written Opinion for PCT US 2010/054984 (Corresponding to U.S. Appl. No. 12/916,984), (Jul. 28, 2011),1-5.

Kabe, T. et al., "Hydrodesulfurization and Hydrodenitrogenation", *Wiley-VCH* (1999), (1999),110-112.

Task Force on Strat. Uncnv. Fuel, "America's Strategic Unconventional Fuels, vol. III Resource and Technology Profiles", *America's Strategic Unconventional Fuels,* vol. III Resource and Technology Profiles (completed Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388 (corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

Yu, Jianfei et al., "High temperature naphthenic acid corrosion of steel in high TAN refining media", *Anti-Corrosion Methods and Materials,* vol. 55 Issue 5, (2008),257-63.

Wang, Chen et al., "High Temperature Naphthenic Acid Corrosion of Typical Steels", *Canadian Journal on Mechanical Sciences and Engineering* vol. 2, No. 2, (Feb. 1, 2011),23-30.

Seo, Sang Y., "International Search Report", PCT App. No. PCT/US2012/046939 (Corresponding to U.S. Appl. No. 13/550,313), (Jan. 31, 2013),1-3.

Seo, Sang Y., "Written Opinion of the International Searching Authority", PCT App. No. PCT/US2012/046939 (Corresponding to U.S. Appl. No. 13/550,313), (Jan. 31, 2013),1-6.

Hwang, Yun K., "International Search Report", PCT App. No. PCT/US2012/065670 (corresponding to U.S. Appl. No. 13/679,696), (Apr. 1, 2013),1-4.

(56) References Cited

OTHER PUBLICATIONS

Hwang, Yun K., "Written Opinion of the International Searching Authority", PCT App. No. PCT/US2012/065670 (corresponding to U.S. Appl. No. 13/679,696), (Apr. 1, 2013),1-8.
Valencia, Juan C., "Non-Final Office Action", U.S. Appl. No. 12/916,984, (Mar. 25, 2013),1-10.
Bentor, Yinon "Chemical Element.com—Sodium", http://www.chemicalelement.com/elements/na.html, (1996),1-3.
Lee, Dong W., "International Search Report", PCT/US2013/023850 (Corresponding to U.S. Appl. No. 13/753,918), (May 14, 2013),1-3.
Lee, Dong W., "Written Opinion of the International Searching Authority", PCT/US2013/023850 (Corresponding to U.S. Appl. No. 13/753,918), (May 14, 2013),1-5.
Wood, Elizabeth D., "Non-Final Office Action", U.S. Appl. No. 13/049,7057, (Jul. 15, 2013),1-7.
"Natural Gas", http://www.gasenergia.com.br/portal/ing/gasnatural/dadostecnicos.jsp, (Jun. 10, 2004),1-20.
Sternberg, et al., "Solubilization of Coal via Reductive Alkylation", *Preprints of Papers—American Chemical Society, Division of Fuel Chemistry* (1970), 14(1), 87-94 (available to the public 1984) CODEN: ACFPAI, ISSN: 0569-3772, (1970),87-94.
Valencia, Juan C., "Non-Final Office Action", U.S. Appl. No. 12/916,984, (Sep. 10, 2013),1-10.
Valencia, Juan C., "Non Final Office Action", U.S. Appl. No. 13/550,313, (Sep. 10, 2013),1-12.
Lee, Dong W., "International Search Report", PCT Application No. PCT/US1350194 (Corresponding to U.S. Appl. No. 13/940,336), (Nov. 5, 2013),1-5.
Lee, Dong W., "Written Opinion of the International Searching Authority", PCT Application No. PCT/US1350194 (Corresponding to U.S. Appl. No. 13/940,336), (Nov. 5, 2013),1-5.
Lee, Dong W., "International Search Report", PCT Application No. PCT/US2013/026698 (Corresponding to U.S. Appl. No. 13/770,610), (Aug. 19, 2013),1-5.
Lee, Dong W., "Written Opinion of the International Searching Authority", PCT Application No. PCT/US2013/026698 (Corresponding to U.S. Appl. No. 13/770,610), (Aug. 19, 2013),1-5.
Valencia, Juan C., "Notice of Allowance", U.S. Appl. No. 13/753,918, (Nov. 20, 2013),1-18.
"Non Final Office Action", Chinese Application No. 201080049770.5 (Dec. 4, 2013),1-18.
Valencia, Juan C., "Notice of Allowance", U.S. Appl. No. 12/916,984, (May 7, 2014),1-9.
Valencia, Juan C., "Notice of Allowance", U.S. Appl. No. 13/550,313, (May 8, 2014),1-8.
Oh, Eung G., "International Search Report", PCT Application No. PCT/US2014/034183 (Corresponding to U.S. Appl. No. 14/253,286), (Aug. 11, 2014),1-3.
Oh, Eung G., "Written Opinion of the International Searching Authority", PCT Application No. PCT/US2014/034183 (Corresponding to U.S. Appl. No. 14/253,286), (Aug. 11, 2014),1-6.
Lee, Chang H., "International Search Report", PCT Application No. PCT/US2014/027292 (Corresponding to U.S. Appl. No. 14/210,891), (Jul. 8, 2014),1-3.
Lee, Chang H., "Written Opinion of the International Search Authority", PCT Application No. PCT/US2014/027292 (Corresponding to U.S. Appl. No. 14/210,891), (Jul. 8, 2014),1-5.
Aizawa, Keisuke "Non-Final Office Action", Japanese Application No. 2012537170, (Aug. 26, 2014),1-6.
Lachman, Richard "Supplementary European Search Report", (Nov. 11, 2014),1-7.
"Non Final Office Action", Chinese Application No. 201080049770.5, (Jul. 1, 2014),1-4.
"Notice on Grant of Patent Right for Invention", Chinese Patent Application No. 201080049770.5, (Oct. 10, 2014),1-4.
Bearden, et al., "Bibliographic data", German Patent Publication DE2558505, (Nov. 18, 1976),1.
Francis, Humblot "Bibliographic data and English Abstract", Korean Patent Publication KR20060032194, (Apr. 14, 2006),1.
Examination Report for SG Application No. 11201402307S, dated Dec. 1, 2015, 11 pages.
Extended European Search Report for EP Application No. 128498383.3, mail date Jun. 12, 2015, 10 pages.
Notice of Reason for Rejection with English Translation for JP Application No. 2014-542519, mail date Mar. 22, 2016, 9 pages.
Search Report and Written Opinion for SG Application No. 11201402307S, mail date Apr. 24, 2015, 19 pages.
Extended European Search Report dated May 30, 2016, in related application EP 13855801.0.
US Notice of Allowance for U.S. Appl. No. 13/679,696 DTD May 9, 2016.
US Notice of Allowance for U.S. Appl. No. 13/770,610 DTD May 4, 2016.
Examiner's Report dated Dec. 18, 2015 for CA Appl 2769863. 4 pages.
Extended European Search Report dated Dec. 7, 2015 on EP 10827610.6 (8 pages).
Extended European Search Report dated Nov. 2, 2015 on EP 13744384.2 (6 pages).
International Preliminary Report on Patentability and Written Opinion dated Oct. 29, 2015 on PCT/US2014/034183, 6 pages.
First Office Action received in CN Pat Appl. No. 201480027207.6 (8 pages).
Wang et al., "Petroleum Processing Technology," China Petrochemical Press, Aug. 2009, pp. 118-121, with English translation (15 pages).
Extended European Search Report in Ep Appl. 10827610.6 dated Mar. 14, 2017 (6 pp.) (1111470121).

* cited by examiner

PROCESS TO SEPARATE ALKALI METAL SALTS FROM ALKALI METAL REACTED HYDROCARBONS

CROSS-REFERENCE TO RELATED APPLICATIONS

This application claims priority to U.S. Provisional Application No. 61/812,057, filed Apr. 15, 2013. This application is a continuation-in-part of U.S. patent application Ser. No. 13/753,918, filed Jan. 30, 2013, entitled "PROCESS FOR DESULFURIZING PETROLEUM FEEDSTOCKS", which application claims the benefit of U.S. Provisional Patent Application Ser. No. 61/594,846, filed Feb. 3, 2012. This application is also a continuation-in-part of U.S. patent application Ser. No. 12/916,984, filed Nov. 1, 2010, entitled "UPGRADING OF PETROLEUM OIL FEEDSTOCKS USING ALKALI METALS AND HYDROCARBONS", which application claims the benefit of U.S. Provisional Patent Application Ser. No. 61/257,369, filed Nov. 2, 2009, entitled "UPGRADING OF PETROLEUM OIL FEEDSTOCKS USING ALKALI METALS AND HYDROCARBONS". All of these prior patent applications are expressly incorporated herein by reference.

U.S. GOVERNMENT INTEREST

This invention was made with government support under Contract No. DE-FE0000408 awarded by the U.S. Department of Energy. The government has certain rights in the invention.

FIELD OF THE INVENTION

The present invention relates to a process for removing nitrogen, sulfur, and heavy metals from sulfur-, nitrogen-, and metal-bearing shale oil, bitumen, heavy oil, or refinery streams using an alkali metal. More particularly, the invention relates to a process to facilitate separation of alkali metal compounds and reduced heavy metals from alkali metal reacted hydrocarbons.

BACKGROUND OF THE INVENTION

U.S. patent application Ser. No. 13/753,918 (which has been incorporated herein by reference) has been published as United States Patent Application Publication No. 2013/0140217. The reader is presumed to be familiar with the disclosure of this published application. This published application will be referred to herein as the "'918 application."

U.S. patent application Ser. No. 12/916,984 (which has been incorporated herein by reference) has been published as United States Patent Application Publication No. 2011/0100874. The reader is presumed to be familiar with the disclosure of this published application. This published application will be referred to herein as the "'984 application."

U.S. Pat. No. 8,088,270, which is expressly incorporated herein by reference, relates to a "Process For Recovering Alkali Metals And Sulfur From Alkali Metal Sulfides And PolySulfides." The reader is presumed to be familiar with the disclosure of this published patent. This published patent will be referred to herein as the "'270 patent."

The demand for energy and the hydrocarbons from which that energy is derived is continually rising. The hydrocarbon raw materials used to provide this energy, however, can contain difficult to remove sulfur and metals that hinder their usage. Sulfur can cause air pollution, and can poison catalysts designed to remove hydrocarbons and nitrogen oxide from motor vehicle exhaust. Similarly, heavy metals contained in the hydrocarbon stream can poison catalysts typically utilized for removal of sulfur.

Extensive reserves of shale oil exist in the U.S. that will increasingly play a role in meeting U.S. energy needs. Over 1 trillion barrel reserves lay in a relatively small area known as the Green River Formation located in Colorado, Utah, and Wyoming. As the price of crude oil rises, these shale oil resources become more attractive. However, technical issues surrounding this shale oil remain to be solved. For example, this shale oil has a relatively high amount of nitrogen contained therein (in addition to high levels of heavy metals and sulfur). Shale oil characteristically is high in nitrogen, sulfur, and heavy metals which makes subsequent hydrotreating difficult. It is known that nitrogen is typically around 2% and sulfur around 1% in most samples of shale oil. Heavy metals may also present. Heavy metals contained in shale oil pose a large problem to upgraders trying to upgrade this shale oil for commercial use. For example, sulfur and nitrogen typically are removed from the shale oil via hydrotreating at elevated temperatures and pressures using catalysts such as Co—Mo/$Al_2O_3$ or Ni—Mo/$Al_2O_3$. However, such catalysts are deactivated (poisoned) by the presence of heavy metals as the heavy metals operate to mask the catalysts.

Another example of a source of hydrocarbon fuel where the removal of sulfur poses a problem is in bitumen existing in ample quantities in Alberta, Canada and heavy oils such as in Venezuela. In order to remove sufficient sulfur from the bitumen for it to be useful as an energy resource, excessive hydrogen must be introduced under extreme conditions, which creates an inefficient and economically undesirable process.

Over the last several years, sodium has been recognized as being effective for the treatment of high-sulfur petroleum oil distillate, crude, heavy oil, bitumen, and shale oil. Sodium is capable of reacting with the oil and its contaminants to dramatically reduce the sulfur, nitrogen, and metal content through the formation of sodium sulfide compounds (sulfide, polysulfide and hydrosulfide). Examples of the processes can be seen in U.S. Pat. Nos. 3,785,965; 3,787,315; 3,788,978; 4,076,613; 5,695,632; 5,935,421; and 6,210,564.

When shale oil, heavy oil, bitumen or other oil feedstock is reacted with the alkali metal, this reaction occurs generally at a temperature between 150-450° C. This reaction is also performed at a pressure that is anywhere between atmospheric pressure and 2000 psi. For example, 2 moles alkali metal and 1 mole hydrogen ($H_2$) may be needed per mole sulfur according to the following initial reaction:

$$R—S—R'+2M+H_2 \rightarrow R—H+R'—H+M_2S,$$

Where M is an alkali metal such as sodium or lithium.

By further example, 3 moles alkali metal and 1.5 moles hydrogen ($H_2$) may be needed per mole nitrogen according to the following initial reaction:

$$R,R',R''—N+3M+1.5H_2 \rightarrow R—H+R'—H+R''—H+M_3N$$

Where R, R', R" represent portions of organic molecules or organic rings.

Alternatively, a method of upgrading an oil feedstock (such as heavy oil, shale oil, bitumen, etc.) may be used by combining the oil feedstock with an alkali metal and an upgradant hydrocarbon material, as disclosed in the '984 application. This reaction operates to remove the sulfur, nitrogen and/or heavy metals contained within the oil feedstock.

It should also be noted that heavy metals contained in the oil feedstock may also be removed via the use of alkali metals such as sodium. Heavy metals contained in organometallic molecules such as complex porphyrins are reduced to the metallic state by the alkali metal. Once the heavy metals have been reduced, they can be separated from the oil because they no longer are chemically bonded to the organic structure. In addition, once the metals are removed from the porphyrin structure, the nitrogen heteroatoms in the structure are exposed for further denitrogenation.

The following is a non-limiting description of the foregoing process of using alkali metals to treat the shale oil, bitumen and/or other oil hydrocarbons. Liquid phase alkali metal is brought into contact with the organic molecules containing heteroatoms and metals in the presence of hydrogen, methane, and also gases such as nitrogen (or inert gases such as helium, neon, argon, krypton, xenon and radon). The free energy of reaction with organic sulfur, organic nitrogen and organic heavy metals is stronger with alkali metals than with hydrogen, so the reaction more readily occurs without full saturation of the organics with hydrogen. (Hydrogen is generally used in the reaction to cap broken bonds previously attached to heteroatoms and metals, prevent carbon-carbon bonds from forming or coking.) Once the alkali metal compounds are formed and heavy metals are reduced to their metallic states, it is necessary to separate these products from the hydrocarbon materials. In many cases, a gravimetric separation, such as centrifugation or filtering, can separate the organic, upgraded oil, from the salt phase, metallic phase, and organic solids which may be formed.

Once the alkali metal compounds are separated from the hydrocarbon feedstock, sulfur and metals are substantially removed, and nitrogen is moderately removed. Also, both viscosity and density are reduced (API gravity is increased). Bitumen or heavy oil would be considered synthetic crude oil (SCO) and can be shipped via pipeline for further refining. Similarly, shale oil will have been considerably upgraded after such processing. Subsequent refining will be easier since the troublesome metals have been removed.

However, for some hydrocarbon feedstocks, gravimetric separation it is not possible without further processing. For example, the inventors have observed that certain hydrocarbon feedstocks that contain a heavy fraction of hydrocarbons, upon processing with an alkali metal produce a mixture of alkali metal compounds and reduced heavy metals that could not be separated from the upgraded hydrocarbon materials through conventional gravimetric separation.

It is an object of the present invention to provide a process to facilitate separation of alkali metal compounds, such as alkali metal sulfides and nitrides, and reduced heavy metals from alkali metal reacted hydrocarbons.

BRIEF SUMMARY OF THE INVENTION

The present invention provides a process to facilitate separation of alkali metal compounds and reduced heavy metals from alkali metal reacted hydrocarbons.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment, but may refer to every embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The disclosed process facilitates gravimetric separation of alkali metal salts from alkali metal reacted hydrocarbons. The process includes heating a mixture resulting from a reaction of an alkali metal and a quantity of a hydrocarbon feedstock having at least one heavy fraction and mechanically mixing the mixture during the heating step. The mixture includes alkali metal salts and alkali metal reacted hydrocarbon feedstock. The mixture is heated to a temperature in the range from about 350° C. to 400° C. The mixture may be heated to a temperature of about 375° C.±10° C. The alkali metal may be sodium or lithium. The alkali metal salts comprise sodium sulfide and/or sodium polysulfide.

In one embodiment, the mixture is heated and mechanically mixed for a time period of over 15 minutes. In another embodiment, the mixture is heated and mechanically mixed for a time period of over 30 minutes. In yet another embodiment, the mixture is heated and mechanically mixed for a time period of at least 1 hour. In a further embodiment, the mixture is heated and mechanically mixed for a time period between about 1 and 2 hours.

The quantity of a hydrocarbon feedstock may be a sulfur-, nitrogen-, and metal-bearing shale oil, bitumen, heavy oil, or refinery stream that contains a heavy fraction. In one embodiment, the hydrocarbon feedstock comprises bitumen.

The process may further comprise the step of separating gravimetrically the alkali metal salts from the alkali metal reacted hydrocarbons.

In one embodiment, the process includes the step of adding a portion of the separated alkali metal salts to the mixture of alkali metal salts and alkali metal reacted hydrocarbons prior to heating. In another embodiment, the process includes the step of adding a portion of the separated alkali metal salts to the hydrocarbon feedstock prior to reacting with the alkali metal.

The disclosed process may be part of a broader process of upgrading a hydrocarbon or oil feedstock. The process is most useful with hydrocarbon feedstocks having at least one heavy fraction, such as bitumen. The hydrocarbon feedstock typically includes at least one carbon atom and a sulfur heteroatom and/or one or more heavy metals. In the process, the quantity of hydrocarbon feedstock is reacted with an alkali metal and an upgradant hydrocarbon, wherein the upgradant hydrocarbon includes at least one carbon atom and at least one hydrogen atom or with hydrogen gas or liquid with hydrogen dissolved within. The alkali metal reacts with the sulfur heteroatom and/or the one or more heavy metals to form one or more inorganic products comprising alkali metal sulfide or alkali metal polysulfides. The upgradant hydrocarbon or hydrogen reacts with the hydrocarbon feedstock to produce an upgraded hydrocarbon feedstock, wherein the number of carbon atoms in the upgraded hydrocarbon feedstock may be greater than the number of carbon atoms in the hydrocarbon feedstock.

The mixture of inorganic products and the upgradant hydrocarbon is heated to a temperature in the range from about 350° C. to 400° C., while undergoing mechanical mixing of the mixture. Thereafter, the inorganic products are gravimetrically separated from the upgraded hydrocarbon feedstock.

The process may include the optional step of adding a portion of the separated inorganic products to the mixture of inorganic products the upgradant hydrocarbon prior to heating. The process may optionally include the step of adding a portion of the separated inorganic products to the hydrocarbon feedstock prior to reacting with the alkali metal.

These features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
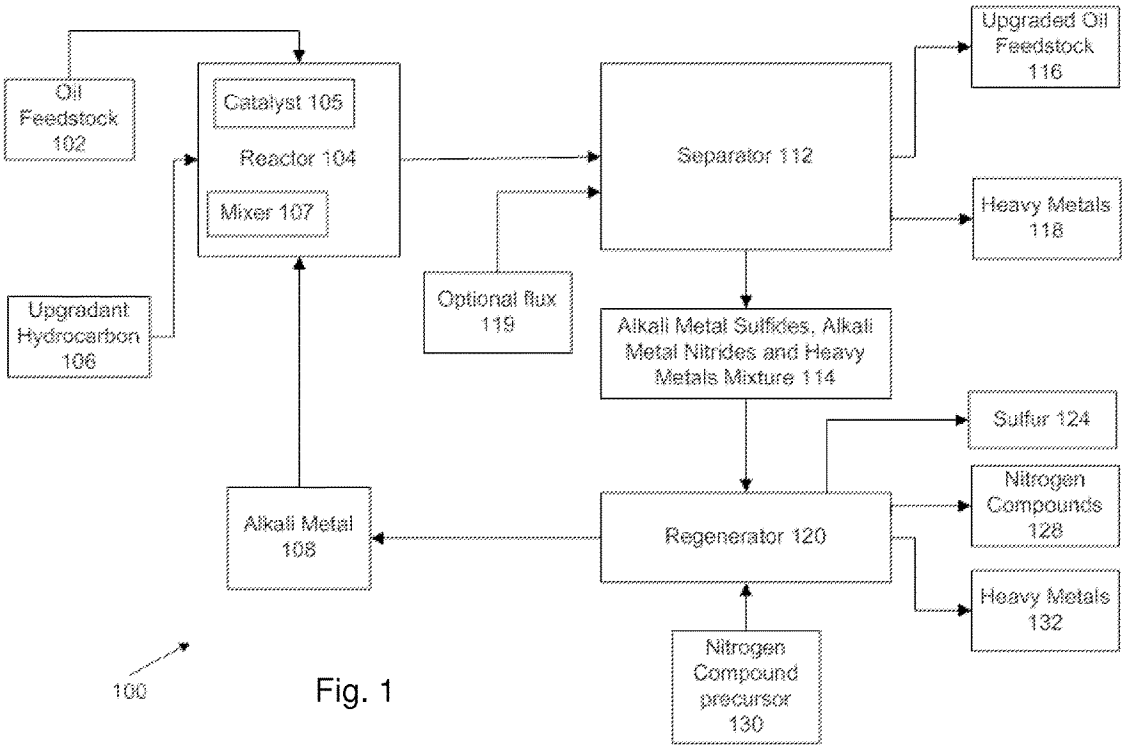
FIG. 1 is flow diagram showing one embodiment of a process of upgrading an oil feedstock.
Figure 2:
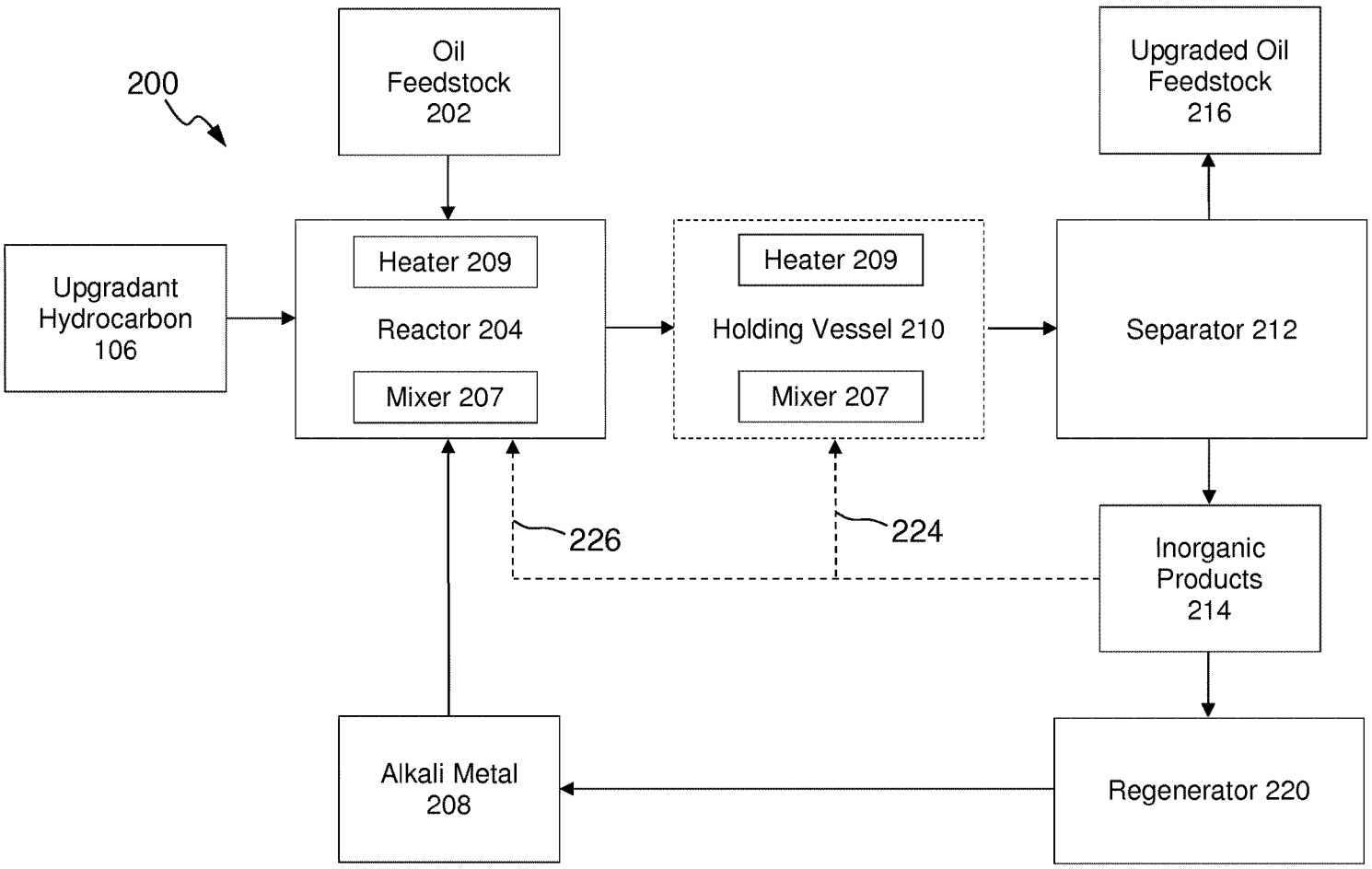
FIG. 2 is a flow diagram showing one embodiment of a process of upgrading an oil feedstock with an alkali metal and for separating inorganic products from the upgraded oil feedstock.

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the methods and cells of the present invention, as represented in FIGS. 1 and 2, is not intended to limit the scope of the invention, as claimed, but is merely representative of present embodiments of the invention.

The present embodiments relate to a method of upgrading a hydrocarbon or oil feedstock (such as heavy oil, shale oil, bitumen, etc.) by combining the oil feedstock with an alkali metal and an upgradant hydrocarbon material or hydrogen, as disclosed in the '984 application, to cap broken bonds previously attached to heteroatoms and metals. This reaction operates to remove the sulfur, nitrogen and/or heavy metals contained within the oil feedstock.

The upgradant hydrocarbon used in this process, may be hydrogen gas ($H_2$), or may be a hydrocarbon. Examples of the hydrocarbons that may be used include methane, ethane, propane, butane, pentane, hexane, ethene, propene, butane, pentene, dienes, and their isomers. Other hydrocarbons (such as octane, or other carbon containing compounds containing one or more carbon atoms) may also be used. The hydrocarbon gas may also be comprised of a mixture of hydrocarbon gases (such as natural gas, or shale gas—the gas produced by retorting oil shale). In many embodiments, the hydrocarbon gas may be methane from natural gas because this component is inexpensive and readily available.

In one embodiment, the hydrocarbon has at least one carbon atom and at least one hydrogen atom. The hydrogen atom should be such that it can be pulled off from the carbon atom to form a bond with the organic molecules of the feedstock. The hydrocarbon atom may include hydrogen atoms bonded therein, but the hydrocarbon molecule must include at least one carbon atom (and thus cannot comprise $H_2$ gas). The hydrocarbon may be selected such that it will increase the ratio of hydrogen to carbon in the organic product. This occurs by selecting the hydrocarbon such that the hydrocarbon has a greater hydrogen-to-carbon ratio than the starting feedstock. Of course, a lower hydrogen-to-carbon ratio in the hydrocarbon can still provide upgrading benefits if the heteroatom content is reduced.

In another embodiment rather than utilizing an upgradant hydrocarbon, hydrogen is utilized or a gas mixture comprising hydrogen.

The hydrocarbon or oil feedstock is combined with the hydrocarbon (such as methane) or hydrogen and the alkali metal (such as sodium) in a reactor vessel and allowed to react for a period of time. The reaction may, in some embodiments, be conducted at a temperature less than about 450° C. In one embodiment, the reaction is conducted at a temperature higher than 150° C. The reaction may be conducted at a pressure higher than about 250 psi. In one embodiment, the reaction is conducted at a pressure below about 2500. Other embodiments may be done at lower temperatures and/or lower pressures.

This process may, in some embodiments, occur in the presence of a catalyst to help promote the chemical reactions. The catalysts may include by way of non-limiting example, molybdenum, nickel, cobalt or alloys of molybdenum, alloys of nickel, alloys of cobalt, alloys of molybdenum containing nickel and/or cobalt, alloys of nickel containing cobalt and/or molybdenum, molybdenum oxide, nickel oxide or cobalt oxides, iron or iron oxide and combinations thereof. Any alkali metal could be used in the process including, but not limited to, mixtures and/or alloys of alkali metals. In some embodiments, potassium, sodium, lithium and/or alloys thereof, may be used.

During this reaction, sulfur and nitrogen atoms separate from the organic molecules in the oil feedstock and combine with the alkali metal (sodium or lithium) to form sulfides and nitrides. These alkali metal sulfides/nitrides are inorganic compounds that separate into an inorganic phase that is distinct from the organic phase housing the organic compounds. A portion of the heavy metals originally contained in the organic materials, such as iron, arsenic and vanadium, are reduced and can also be separated into the inorganic phase as well. The resulting organic compounds are in the organic phase and react with the upgradant hydrocarbon, such as methane or with hydrogen. Because the heteroatoms react with the alkali metal, the resulting product has a lower heteroatom to carbon ratio than the original oil feedstock.

The alkali metal may be added to the reaction vessel because the free energy of formation of the alkali metal sulfide is greater than the free energy of formation of $H_2S$. In one embodiment, the reaction proceeds more readily with the introduction of the alkali metal. In one embodiment, the alkali metal may include sodium, lithium, or the like.

Referring now to FIG. 1, a schematic method 100 of an embodiment for upgrading an oil feedstock is disclosed. As can be seen from FIG. 1, a quantity of oil feedstock 102 is obtained. This oil feedstock 102 may comprise bitumen, shale oil, heavy oil, or other materials described herein. The oil feedstock 102 may be obtained via mining or other processes. The oil feedstock 102 is added to a reaction vessel 104 (which is referred to herein as reactor 104). The reactor 104 may include a mixer 107 that is designed to mix (stir) the chemicals added therein in order to facilitate a reaction. A catalyst 105 of the type described above may also be added to the reactor 104 to foster the reaction.

Also added to the reactor 104 is a quantity of an alkali metal 108. This alkali metal 108 may be any alkali metal 108 and may include mixtures of alkali metals 108. In some embodiments, sodium or lithium may be used.

A quantity of an upgradant hydrocarbon 106 may also be used and added to the reactor 104 or in place of upgradant hydrocarbon hydrogen may be used. As noted above, this upgradant hydrocarbon 106 may be methane, ethane, propane, etc. or any other hydrocarbon (or even mixtures thereof). However, because of its relative inexpensive nature, natural gas or shale oil gas (which generally contains methane $CH_4$) may be used.

As noted herein, the reactor 104 may cause the reaction to occur at a certain temperature or pressure. In some embodiments, the temperature used for the reaction may be elevated up to about 450° C. One exemplary temperature may be 350° C. In other embodiments, the temperature may be such that the alkali metal 108 is in a molten state. It will be appreciated by those of skill in the art that sodium becomes molten at about 98° C. whereas lithium becomes molten at about 180° C. Thus, embodiments may be designed in which the temperature of the reactor 104 is at a temperature above the melting temperature of the alkali metal 108. The pressure of the reaction may be anywhere from atmospheric pressure and above. Some exemplary embodiments are performed at a pressure that is above about 250 psi. Other embodiment may be performed at a pressure that is below about 2500 psi.

When the temperature is elevated, the alkali metal 108 may be molten to facilitate the mixing of this chemical with the other chemicals. However, other embodiments may be designed in which a powdered or other solid quantity of the alkali metal 108 is blown into, or otherwise introduced, into the reactor 104 so that it reacts with the other chemicals.

In a reaction that occurs in the reactor 104, the heteroatoms (such as sulfur and nitrogen) and other heavy metals are removed from the oil feedstock 102. The products from the reactor 104 are then sent to a separator 112. The separator 112 may include a variety of devices/processes that are designed to separate the upgraded oil feedstock 116 from the other reaction products. The separator 112 may include filters, centrifuges and the like. The separator 112 may also receive, depending upon the embodiment, an influx of a flux 119. This flux material 119 may be hydrogen sulfide $H_2S$ or water or other chemical(s) that facilitate the separation. Mixing the treated feedstock with hydrogen sulfide to form an alkali hydrosulfide can form a separate phase from the organic phase (oil feedstock). This reaction is shown below, in which sodium (Na) is the alkali metal, although other alkali metals may also be used:

$$Na_2S+H_2S \rightarrow 2NaHS \text{ (which is a liquid at 375° C.)}$$

$$Na_3N+3H_2S \rightarrow 3NaHS+NH_3$$

The nitrogen product is removed in the form of ammonia gas ($NH_3$) which may be vented and recovered, whereas the sulfur product is removed in the form of an alkali hydro sulfide, NaHS, which is separated for further processing. Any reduced heavy metals will also be separated out from the organic hydrocarbons by gravimetric separation techniques.

The flux may be ammonia utilized to scavenge unreacted alkali metal. Then the alkali metal laden ammonia is separated from the oil, flashed off and the alkali metal may be sent back to the reactor for further processing.

Some heavy metals 118 which were reduced from the feedstock 102 may separate here and be extracted as heavy metals 118. The separation also produces the organic product, which is the upgraded oil feedstock 116. This upgraded oil feedstock 116 may be shipped to a refinery for further processing, as needed, to make this material a suitable hydrocarbon fuel. Another output of the separator 112 is a mixture 114 (stream) of alkali metal sulfides, alkali metal nitrides, and heavy metals 118. This mixture 114 may be further processed as described below. Alternatively or additionally, any nitrogen containing products (such as via ammonia gas ($NH_3$) that is vented off and collected) may also be removed from this stage depending on the type of the process employed.

The mixture 114 of alkali metal sulfides, alkali metal nitrides, and heavy metals 118 may be thermally processed as described in the 217 application where the mixture is heated to elevated temperature in a non-oxidizing and dry atmosphere then may be sent to a regenerator 120. The purpose of the regenerator 120 is to regenerate the alkali metal 108 so that it may be reused in further processing at the reactor 104. Thus, one of the outputs of the regenerator 120 is a quantity of the alkali metal 108. In many embodiments, the regeneration step involves an electrolytic reaction (electrolysis) of an alkali metal sulfide and/or polysulfide using an alkali metal ion conductive ceramic membrane (such as, for example, a NaSiCON or LiSiCON membrane that is commercially available from Ceramatec, Inc. of Salt Lake City, Utah). Non-limiting examples of such processes are found in U.S. Pat. No. 8,088,270, the '918 application, and the '984 application. The result of this electrolysis process is that sulfur 124 will be captured. Further, heavy metals 132 may be separated from the mixture 114, via the electrolysis process or other processes. In further embodiments, the nitrogen containing compounds 128 may also be collected at the regenerator 120. As noted above, such nitrogen compounds 128 may be ammonia gas that is vented off or collected. In other embodiments, nitrogen compound precursors 130 are added to the regenerator 120 to capture/react with the nitrogen containing compounds in the mixture 114 and produce the compounds 128. Those skilled in the art will appreciate the various chemicals and processes that may be used to capture the nitrogen compounds 128 (or to otherwise process the nitrogen obtained from the reaction).

The method 100 of FIG. 1 may be run as a batch process or may be a continuous process, depending upon the embodiment. Specifically, if it is a continuous process, the reactants would be continuously added to the reactor 104 and the products continuously removed, separated, etc. Further, the reaction in the reactor 104 may be performed as a single step (e.g., placing all of the chemicals into a single reactor 104) or potentially done as a series of steps or reactions.

Referring now to FIG. 2, a schematic method 200 of an embodiment for upgrading an oil feedstock is disclosed. The disclosed method is based upon the method of FIG. 1. Even though some features shown in FIG. 1 are not reproduced in relation to FIG. 2, it is to be understood that FIG. 2 can include the features discussed above. As can be seen from FIG. 2, a quantity of oil feedstock 202 is obtained. This oil feedstock 202 may comprise bitumen, shale oil, heavy oil, or other materials described herein that contains a heavy fraction. As used herein, the term "heavy fraction" refers to one or more fractions that have a boiling point above 524° C. Bitumen is known to contain a heavy fraction. The oil feedstock 202 may be obtained via mining or other processes. The oil feedstock 202 is added to a reaction vessel 204 (which is referred to herein as reactor 204). The reactor 204 may include a mixer 207 that is designed to mix (stir) the chemicals added therein in order to facilitate a reaction. The reactor 204 may also include a heater 209 to heat the reactants to a predetermined temperature.

Also added to the reactor 204 is a quantity of an alkali metal 208. This alkali metal 208 may be any alkali metal 208 and may include mixtures of alkali metals 208. In some embodiments, sodium or lithium may be used.

A quantity of an upgradant hydrocarbon 206 or hydrogen may also be used and added to the reactor 204. As noted above, this upgradant hydrocarbon 206 may be methane, ethane, propane, etc. or any other hydrocarbon (or even mixtures thereof). However, because of its relative inexpensive nature, natural gas or shale oil gas (which generally contains methane $CH_4$) may be used but alternatively hydrogen may be used or a mixture thereof.

As noted herein, the reactor 204 may cause the reaction to occur at a certain temperature or pressure. In some embodiments, the temperature used for the reaction may be elevated up to about 450° C. One exemplary temperature may be 350° C. In some embodiments, the temperature may be such that the alkali metal 208 is in a molten state. It will be appreciated by those of skill in the art that sodium becomes molten at about 98° C. whereas lithium becomes molten at about 180° C. Thus, embodiments may be designed in which the temperature of the reactor 204 is at a temperature above the melting temperature of the alkali metal 208. The pressure of the reaction may be anywhere from atmospheric pressure and above. Some exemplary embodiments are performed at a pressure that is above about 250 psi. Other embodiment may be performed at a pressure that is below about 2500 psi.

In a reaction that occurs in the reactor 204, the heteroatoms (such as sulfur and nitrogen) and other heavy metals are converted into a mixture of alkali metal sulfides or polysulfides, alkali metal nitrides, and heavy metals, collectively referred to as inorganic products and the upgraded oil feedstock. It has been observed that when the oil feedstock 202 contains a heavy fraction, the mixture of inorganic products and upgraded oil feedstock cannot be effectively separated without further processing.

As shown in FIG. 2, the inorganic products and upgraded oil feedstock are introduced into a holding vessel 210 that also contains a mixer 207 and a heater 209. The holding vessel 210 is shown in dashed lines because it can be a vessel separate from the reactor 204 or it can be the reactor 204 itself. The mixture of inorganic products and upgraded oil feedstock are heated to a temperature in the range from about 350° C. to 400° C., and the mixture is mechanically mixed during the heating step. The mixture may be heated to a temperature of about 375° C.±10° C.

In one embodiment, the mixture is heated and mechanically mixed for a time period of over 15 minutes. In another embodiment, the mixture is heated and mechanically mixed for a time period of over 30 minutes. In yet another embodiment, the mixture is heated and mechanically mixed for a time period of at least 1 hour. In a further embodiment, the mixture is heated and mechanically mixed for a time period between about 1 and 2 hours.

The mixture of alkali metal reaction products from the reactor 204 are then sent to a separator 212. The separator 212 may include a variety of devices/processes that are designed to separate the upgraded oil feedstock 216 from the other reaction products. The separator 212 may include filters, centrifuges and the like.

The organic product, which is the upgraded oil feedstock 216. This upgraded oil feedstock 216 may be shipped to a refinery for further processing, as needed, to make this material a suitable hydrocarbon fuel. Another output of the separator 212 is a mixture 214 (stream) of alkali metal sulfides, alkali metal nitrides, and heavy metals. This mixture 214 may be further processed as described below. Alternatively or additionally, any nitrogen containing products (such as via ammonia gas ($NH_3$) that is vented off and collected) may also be removed from this stage depending on the type of the process employed.

The inorganic products 214, which contain a mixture of alkali metal salts, such as alkali metal sulfides, alkali metal nitrides, and/or heavy metals, may be thermally processed as described in the 217 application where the mixture is heated to elevated temperature in a non-oxidizing and dry atmosphere then may be sent to a regenerator 220. The purpose of the regenerator 220 is to regenerate the alkali metal 208 so that it may be reused in further processing at the reactor 204. Thus, one of the outputs of the regenerator 220 is a quantity of the alkali metal 208.

In one embodiment, the process shown in FIG. 2 includes the ability to add a portion of the separated inorganic products, such as the alkali metal sulfides or polysulfides, to the mixture of inorganic products and upgraded oil feedstock prior to heating in the holding vessel 210. Without being bound by theory, it is currently believed that the separated inorganic products may provide a "seed" to facilitate the agglomeration of fine alkali metal sulfide particles within the mixture, which ultimately facilitates the separation process. Thus, a recycle stream 224 is provided in which a portion of the separated inorganic products may be fed to the holding vessel 210.

In another related embodiment, the process shown in FIG. 2 includes the ability to add a portion of the separated inorganic products to the oil feedstock prior to reacting with the alkali metal. Without being bound by theory, it is currently believed that the separated inorganic products may provide a "seed" to facilitate the agglomeration of fine alkali metal sulfide particles within the mixture, which ultimately facilitates the separation process. Thus, a recycle stream 226 is provided in which a portion of the separated inorganic products may be fed to the reactor 204. The seeding process may occur before alkali metal addition or after alkali metal addition.

It has been observed that by taking a mixture of alkali metal compounds and reduced heavy metals from alkali metal reacted hydrocarbons to an elevated temperature, for example to 375° C.±10° C., a temperature where negligible thermal cracking is expected to occur, and mixing the constituents for a period of time, for example 1-2 hours, and then cooling the mixture, the solids and liquids could easily be separated by centrifugation or other gravimetrical separation methods.

Without being bound by theory, when sodium reacts with the organic sulfur in the oil feedstock, sodium sulfide forms at the molecular level. Initially, the sodium sulfide particles are so fine they will not separate easily even though they have higher specific gravity than the oil feedstock. However, by mixing the mixture of alkali metal compounds, reduced heavy metals, and alkali metal reacted hydrocarbon feedstock for a period of time at elevated temperature, the fine particles are believed to agglomerate or form clusters to a size large enough where they can separate gravimetrically. Recycling inorganic has shown to be very effective in enabling the reduction of the amount of time necessary to conduct the mixing at elevated temperature after reaction and still separate the inorganic material from the organic.

Experiments showed that mixing at too low of a temperature, for example at 300° C., for 2 hours the fine particles still would not separate using conventional methods but mixing at a higher temperature, 380° C. for 1 hour resulted in a mixture that would mostly separate. For example about 90% of the sodium sulfide formed would separate easily by centrifugation. By stirring at 2 hours at 380° C., 99% of the sodium sulfide formed would separate by centrifugation.

In the experiments conducted, it was evident when the alkali metal sulfide particles agglomerated to an extent because the viscosity slowly dropped over time then eventually stabilized with time. When power was applied to the agitator in the mixing vessel, the speed of the agitator increased as the viscosity declined then eventually stabilized. It is understood that the time required for the process to occur will vary depending on many parameters such as mixing efficiency, starting viscosity, and temperature.

It is understood that the oil feedstock in this invention may originate from many sources such as petroleum, heavy oil, retorted oil shale, bitumen, and oil refinery streams where the oil originally comprised organic sulfur. The disclosed process is most applicable to oil feedstocks that contain a heavy fraction.

In another experiment, using an Alberta bitumen feedstock with approximately 50% resid fraction which boiled above 524° C. and with 53% starting sulfur concentration. 104 g of recycled inorganic material from a previous batch reactor run was added to 650 g fresh bitumen. The recycle material was intended to serve as "seed" for agglomeration of the inorganic material as it was formed during the course of reaction with 48.5 g sodium metal where the reaction was conducted at 357° C. and 1500 psi with hydrogen atmosphere mixed in during the reaction. There was no further mixing after the initial reaction with sodium. When "seed" was utilized the mixture leaving the reactor was centrifuged and the product sulfur concentration was 1.32%. When the "seed" was not used the sulfur concentration remained nearly the same in the oil because the sodium sulfide that was produced remained in the oil and could not be separated through centrifugation.

In another related embodiment, a process to facilitate separation of alkali metal salts from alkali metal reacted hydrocarbons includes adding a portion of the separated alkali metal salts to the mixture of alkali metal hydrocarbon feedstock having at least one heavy fraction. The mixture may include alkali metal salts and alkali metal reacted hydrocarbons. The process may also include adding a portion of the separated alkali metals salts to the mixture of alkali metal hydrocarbon feedstock prior to addition of the alkali metal. In a related process for removal of residual alkali metal from alkali metal reacted hydrocarbons, a flux is mixed with the hydrocarbon to dissolve the alkali metal. In one embodiment, the flux is ammonia. The ammonia with dissolved alkali metal may be flashed off to yield the alkali metal.

While specific embodiments of the present invention have been illustrated and described, numerous modifications come to mind without significantly departing from the spirit of the invention, and the scope of protection is only limited by the scope of the accompanying claims.

The invention claimed is:

1. A process to facilitate separation of alkali metal salts from alkali metal reacted hydrocarbons consisting of:

contacting a quantity of a hydrocarbon feedstock having at least one heavy fraction with molten alkali metal and optionally with hydrogen to provide a mixture comprising inorganic products and alkali metal reacted hydrocarbons, wherein the inorganic products comprise alkali metal salts;

separating the inorganic products from said mixture by heating the mixture to a temperature in the range from about 350° C. to 400° C. and mechanically mixing the mixture during the heating step; and gravimetrically separating the alkali metal salts from the alkali metal reacted hydrocarbons.

2. The process according to claim 1, wherein the mixture is heated to a temperature of about 375° C.±10° C.

3. The process according to claim 1, wherein the mixture is heated and mechanically mixed for a time period of over 15 minutes.

4. The process according to claim 1, wherein the mixture is heated and mechanically mixed for a time period of over 30 minutes.

5. The process according to claim 1, wherein the mixture is heated and mechanically mixed for a time period of at least 1 hour.

6. The process according to claim 1, wherein the mixture is heated and mechanically mixed for a time period between about 1 and 2 hours.

7. The process according to claim 1, wherein the quantity of a hydrocarbon feedstock comprises bitumen, heavy oil, or a refinery stream containing a heavy fraction.

8. The process according to claim 1, wherein the contacting step is carried out in a reactor and the heating/mixing step is carried out in a separate vessel.

9. The process according to claim 1, wherein the hydrocarbon feedstock is contacted with molten alkali metal and hydrogen gas or hydrogen dissolved in liquid.

10. A process to facilitate separation of alkali metal salts from alkali metal reacted hydrocarbons consisting of:

contacting a quantity of a hydrocarbon feedstock having at least one heavy fraction with molten alkali metal and optionally with hydrogen to provide a mixture comprising inorganic products and alkali metal reacted hydrocarbons, wherein the inorganic products comprise alkali metal salts;

separating the inorganic products from said mixture by heating the mixture to a temperature in the range from about 350° C. to 400° C. and mechanically mixing the mixture during the heating step;

adding a portion of previously separated alkali metal salts to the mixture comprising inorganic products and alkali metal reacted hydrocarbons prior to heating, and/or adding a portion of previously separated alkali metal salts to the hydrocarbon feedstock prior to reacting with the alkali metal; and gravimetrically separating the alkali metal salts from the alkali metal reacted hydrocarbons.

11. A process to facilitate separation of sodium sulfide and/or sodium polysulfide from sodium-reacted hydrocarbons consisting of:

contacting in a reactor molten sodium, hydrogen and a quantity of a hydrocarbon feedstock having at least one heavy fraction to provide a mixture comprising sodium sulfide and/or sodium polysulfide and sodium-reacted hydrocarbons;

heating the mixture to a temperature in the range from about 350° C. to 400° C.;

mechanically mixing in a separate vessel the mixture during the heating step, wherein the mixture is heated and mechanically mixed for a time period of over 15 minutes to 2 hours; and separating gravimetrically the sodium sulfide and/or sodium polysulfide from the sodium-reacted hydrocarbons; and optionally a step of adding a portion of the separated sodium sulfide salts to the mixture of sodium salts and sodium reacted hydrocarbons prior to heating or a step of adding a portion of the separated sodium sulfide salts to the hydrocarbon feedstock prior to reacting with the sodium.

12. The process according to claim 11, wherein the mixture is heated to a temperature of about 375° C.±10° C.

13. The process according to claim 11, wherein the quantity of a hydrocarbon feedstock comprises bitumen, heavy oil, or a refinery stream containing a heavy fraction.

14. The process according to claim 11, wherein the contacting step is carried out in a reactor and the heating/mixing step is carried out in a separate vessel.

15. A process of upgrading a hydrocarbon feedstock consisting of:

obtaining a quantity of hydrocarbon feedstock having at least one heavy fraction, the hydrocarbon feedstock comprising at least one carbon atom and a sulfur heteroatom and/or one or more heavy metals;

reacting the quantity of the hydrocarbon feedstock with a molten alkali metal and an upgradant hydrocarbon and optionally hydrogen to produce an upgraded hydrocarbon feedstock, wherein the upgradant hydrocarbon comprises at least one carbon atom and at least one hydrogen atom and has a greater hydrogen-to-carbon ratio than the hydrocarbon feedstock, the alkali metal reacts with the sulfur heteroatom and/or the one or more heavy metals to form one or more inorganic products comprising alkali metal sulfide or alkali metal polysulfides, and the number of carbon atoms in the upgraded hydrocarbon feedstock is greater than the number of carbon atoms in the hydrocarbon feedstock;

heating the mixture of inorganic products and the upgraded hydrocarbon feedstock to a temperature in the range from about 350° C. to 400° C.;

mechanically mixing the mixture during the heating step; and gravimetrically separating the inorganic products from the upgraded hydrocarbon feedstock; and optionally a step of adding a portion of the separated inorganic products to the mixture of inorganic products and upgraded hydrocarbons prior to heating or a step of adding a portion of the separated inorganic products to the hydrocarbon feedstock prior to reacting with the alkali metal.

16. The process according to claim 15, wherein the quantity of hydrocarbon feedstock comprises bitumen, heavy oil, or a refinery stream containing a heavy fraction.

17. The process according to claim 15, wherein the upgradant hydrocarbon is selected from the group consisting of methane, ethane, propane, pentane, hexane, ethene, propene, pentene, dienes, isomers of any of the foregoing, and mixtures thereof.

18. The process according to claim 15, wherein the upgradant hydrocarbon is selected from the group consisting of natural gas and shale gas.

19. The process according to claim 15, wherein the reacting step is carried out in a reactor and the heating/mixing step is carried out in a separate vessel.

* * * * *